United States Patent [19]

Miller

[11] Patent Number: 5,061,109

[45] Date of Patent: Oct. 29, 1991

[54] FENCE POST BRACING AND METHOD OF INSTALLATION OF SAME IN A SECTION OF FENCE

[76] Inventor: Donald Miller, Gay La., Wilton, Calif. 95693

[21] Appl. No.: 616,760

[22] Filed: Nov. 16, 1990

Related U.S. Application Data

[63] Continuation-in-part of Ser. No. 463,144, Jan. 8, 1990, abandoned.

[51] Int. Cl.[5] ..... F16C 11/00

[52] U.S. Cl. ..... 403/36; 403/35

[58] Field of Search ..... 256/35, 36, 37

[56] References Cited

U.S. PATENT DOCUMENTS

| | | | |
|---|---|---|---|
| 1,815,994 | 7/1931 | Thompson | 256/35 |
| 3,674,243 | 7/1972 | Brown | 256/35 X |
| 4,349,181 | 9/1982 | Asher et al. | 252/35 |
| 4,582,300 | 4/1986 | Chappell . | |
| 4,682,761 | 7/1987 | Hanneken | 256/36 |
| 4,763,879 | 8/1988 | Wasicek et al. | 256/36 |
| 4,889,322 | 12/1989 | Wagner | 252/36 |

*Primary Examiner*—Andrew V. Kundrat

[57] ABSTRACT

Improved fence bracing members, and a method of using the bracing members on metal T-posts of a fence. The bracing members include two substantially identical elongated first members each made of corrosion resistant tubing, and further having somewhat flexible U-shaped or hooked oppositely disposed ends. Each hooked end of the first bracing members is apertured to receive a single bolt to allow the compressing of the hook onto a T-post. The first bracing members are structured for spanning horizontally between, and attaching with the hooked portions placed around a T-post. One first bracing member is placed adjacent the ground, and one first bracing member is placed adjacent the upper ends of the T-posts. An elongated straight bracing member having bolt receiving apertures at two oppositely disposed terminal ends thereof, is used for a diagonal brace between the two vertical T-posts, extending at an angle from an attachment point to the upper bracing member adjacent one T-post, downward at an angle to an attachment point to the lower bracing member adjacent the other T-post. Nuts and bolts are used to attach the bracing members on T-posts installed in the ground. The bracing members having the hooked ends have been structured in a manner which allows the brace to be used as a measuring gage for quickly determining the proper distance two T-posts should be set apart prior to bracing.

8 Claims, 5 Drawing Sheets

FENCE POST BRACING AND METHOD OF INSTALLATION OF SAME IN A SECTION OF FENCE

CROSS-REFERENCES TO RELATED APPLICATIONS

This is a continuation-in-part of Ser. No. 07/463,144 filed Jan. 8, 1990, now abandoned.

BACKGROUND OF THE INVENTION

1. Field of the Invention

This invention relates to fence construction in general, and more precisely to improved construction of fence post bracing members, and a method of use thereof in a section of fence.

2. Description of the Prior Art

Large tracts of land are often fenced in with metal posts and individual strands of wire such as barbed wire, or with hog or chicken wire fencing. Fencing using metal posts is quick to install, can be accomplished by one or two persons, and is relatively inexpensive and durable. The most common and cost effective metal posts used for individual stranded wire fencing are referred to as "t-bar" posts or simply "T-posts", which are available in a variety of lengths. T-posts may be driven into the ground with a sledge hammer or fence post driver, unlike wooden posts or round metal posts which require a post receiving hole to be dug into the ground in which to set the post. Each typical T-post has a flat vertical face having a series of projections or lugs which help to secure individual strands of wire in place. Normally, horizontally disposed individual strands of wire such as barbed wire, are placed at spaced intervals extending along a row of T-posts. The wire strands are stretched tight, and fastened to each post with available snap-on wire clips or tied in place with short lengths of wire. The snap-on clips retain the wire against the T-posts, and the projecting lugs on the T-posts rest underneath each wire to prevent the wire from sliding downward. Often, leverage type mechanical wire stretchers are utilized to initially stretch the wire to a proper tension. With wire fencing, it is important to maintain the individual wire strands stretched tight in order to maintain the proper spacing between the strands of wire. If the strands of wire become loose, and the proper spacing between the strands is lost, animals such as cattle contained within the fence may be able to crawl between the wires and escape. Some factors which allow the individual wires of a fence to become loose, include the posts bending, the posts moving in the ground due to the tension of the wires, and often animals such as cattle or horses pushing against the fence to reach the greener grass on the other side, apply such pressure on the wires that the nearby posts in the fence bend or move toward the point of applied pressure.

In order to allow the proper initial tightening of the strands of wire, and to maintain the wire stretched tight after installation, post bracing is utilized. Post bracing is utilized at about 200 foot intervals in straight rows of wire fencing, at corners in the fence, and at the end of a fence such as in cross-fencing. Post bracing reinforces the entire fence for a substantial distance on either side of the braced posts.

When using T-post for fencing, due to a lack of other suitably structured and cost effective bracing members available on the market for bracing T-posts, generally, two vertical wooden posts are used at the 200 foot intervals to allow the bracing of the two vertical posts with wooden diagonal or horizontal bracing extending from one wooden post to the other, coupled with tightly strung diagonal wires or straps between the two vertical wooden posts. Wooden post are also installed in otherwise all metal fencing arrangement at corners, again to enable proper bracing of the posts. Typically in the corners of T-post wire fencing arrangements, three vertical wooden posts are used, with wooden bracing members and diagonal wire straps extending between the vertical posts. The wooden bracing members and diagonal straps distribute the stresses applied to the fence posts, thereby stabilizing and reinforcing the posts, and assisting in maintaining the proper tension on the wire of the fence.

Metal T-posts will eventually rust or rot off at the ground line necessitating replacement thereof, as will wooden posts. However, in a fencing arrangement primarily comprised of metal, that is, metal wire and metal T-posts, but which includes wooden posts at spaced intervals in the straight runs and at the fence corners installed to allow post bracing, replacement of the wooden posts will be necessary several times before that of the metal T-posts or wire fencing. The replacement of fence posts is somewhat labor intensive, and therefore is costly. Often a metal T-post will last as long as 40 years, whereas a wooden post may only last 10 years before needing replacement. It is a fairly widely accepted theory that it is more economical to install fencing of which all components of the fence have an approximate equal and long rated useful life. By all components of the fence having the approximate equal rated useful life, maintenance cost may be dramatically reduced, the savings being primarily in labor costs.

Furthermore, wooden posts have been in the past, and are today almost always treated with chemical preservatives to add to the useful life of the post, and this with only limited success. Some of the older wood preservatives once thought safe, have recently been determined to be unsafe, and have been pulled from the market, being listed now as hazardous materials. Many people feel the currently used and approved wood preservatives may not be safe for human contact or the environment either.

Although a variety of different fencing systems and components have been developed over the years, some of which include teachings of metal fence post bracing members and the use thereof, no related prior art is seen to provide all of the advantages of the invention of this disclosure.

SUMMARY OF THE INVENTION

In practicing my invention, I have developed improved metal fence bracing members, and a method of using my bracing members on metal T-posts in a section of a wire fence. The bracing members include two substantially identical elongated first members each made of corrosion resistant tubing, and further having somewhat flexible U-shaped or hooked oppositely disposed ends. Each hooked end of the first bracing member is apertured to receive a single bolt. The first bracing members are structured for spanning horizontally between, and attaching with the hooked portions placed around two T-posts. One first bracing member is placed adjacent the ground, and one first bracing member is placed adjacent the upper ends of the T-posts. Also included is an elongated straight bracing member, comprising rigid corrosion resistant tubing having bolt receiving apertures at the two oppositely disposed terminal ends thereof. The straight bracing member is used for a diagonal brace between the two vertical T-posts, extending at an angle from an attachment point to a hook of the upper bracing member adjacent one T-post, downward at an angle to an attachment point to a hook of the lower bracing member adjacent the other T-post. A total of four bolts passed through the apertures of the bracing members, and four nuts on the bolts are all that is required to attach the three bracing members on two T-post installed in the ground. The use of the three bracing members in combination between two T-posts forms a double triangle which has a tendency to distribute and transfer lengthwise pulling pressures applied to the braced fence downward through the diagonal brace to a point adjacent the ground of one braced T-post, and thereby substantially stiffens the two T-posts in position.

In an effort to ensure the fewest possible tools needed, and to ensure the fastest possible installation, my bracing members having the hooked ends have been structured in a manner which allows the brace to be used as a measuring gage for quickly determining the proper distance two T-posts should be set apart prior to bracing with two of my hooked members, and one of my straight diagonal bracing members.

Objects of the present invention include as a primary object the providing of suitably structured fence bracing members and a method of using the bracing members with metal T-posts in fencing.

A further object of the invention is to provide the above which is quick and easy to assemble and disassemble, being uncomplicated and few in parts.

A further object of the invention is to provide the above wherein the bracing members and method of use is suitable for use on a variety of sloping and level terrain surfaces, such as found with hills and gullies.

A further object of the invention is to provide the above wherein the bracing members and method of use thereof is suitable for use on new fencing installation, and is also suitable for retrofitting an existing T-post wire fence without disturbing the previously installed fence wire.

A further object of the invention is to provide the above wherein the bracing members and method of use thereof does not require holes to be dug in the ground.

A further object of the invention is to provide the above wherein the bracing members and method of use thereof eliminate the need to use wood in the fence, thereby allowing the fence to be more durable.

A further object of the invention is to provide the above wherein the bracing members are inexpensive to manufacture of strong and durable, yet lightweight materials, and therefore should be able to be purchased by the consumer at a relatively low cost.

Other objects and advantages of the invention will become apparent by reading the remaining specification and subsequent comparison with the accompanying numbered drawings.

BRIEF DESCRIPTION OF THE DRAWINGS

FIG. 5 A is a cross-sectional view taken along line 5 A of FIG. 5.

BEST MODE FOR CARRYING OUT THE INVENTION

Figure 1:
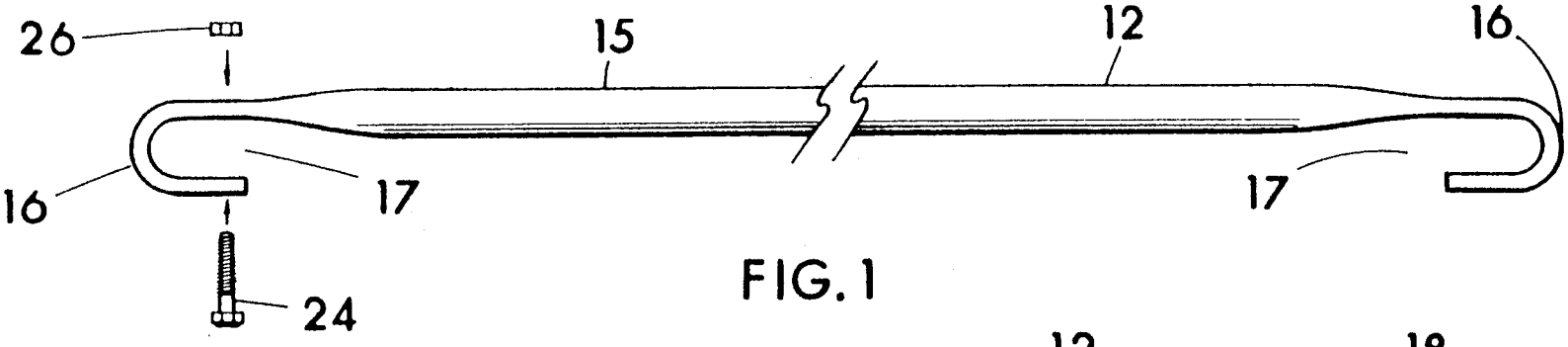
FIG. 1 illustrates in a side view, an example of a preferred embodiment of a first brace member having the U-shaped or hooked ends.
Figure 2:
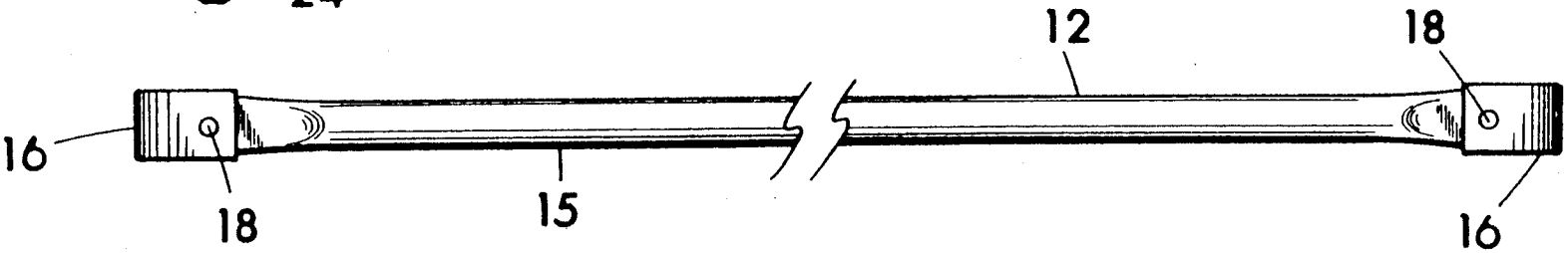
FIG. 2 is a top view of the example of the first brace member.
Figure 3:
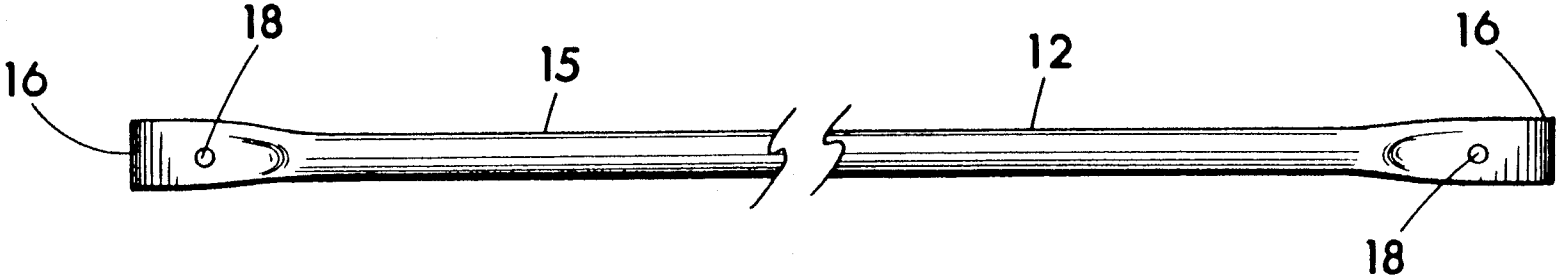
FIG. 3 is a bottom view of the example of the first brace member.
Figure 4:
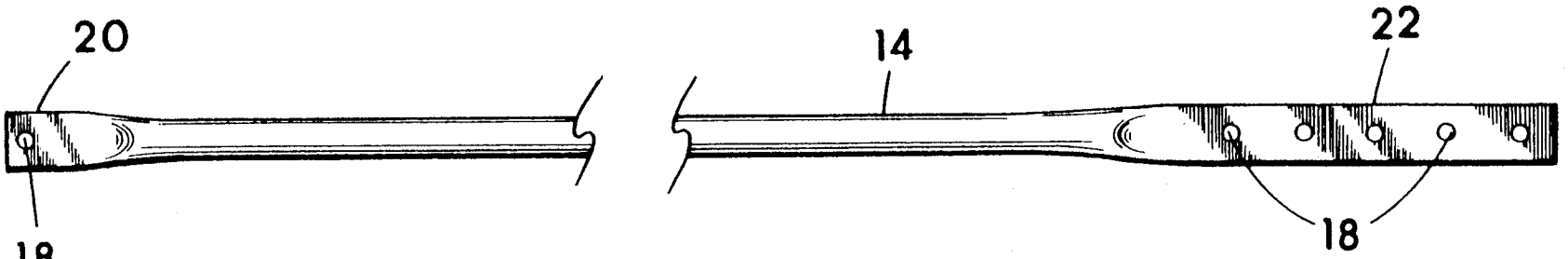
FIG. 4 illustrates in a top view, an example of a preferred embodiment of a straight brace member used as a diagonal brace, with the opposite or bottom side thereof appearing substantially the same.
Figure 5:
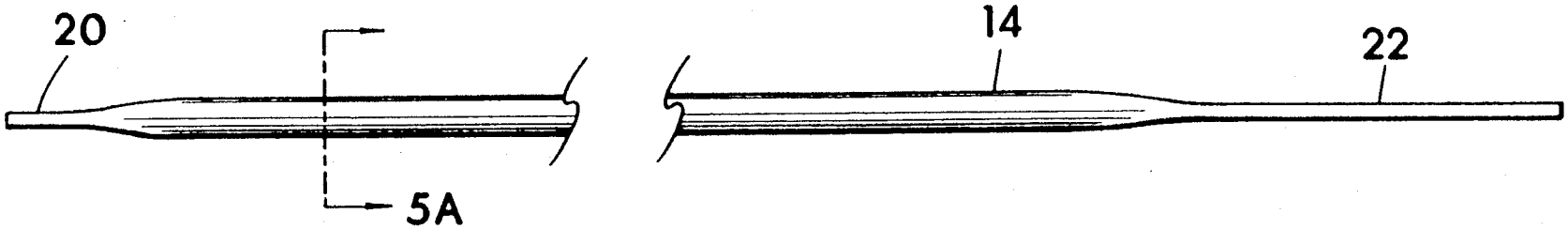
FIG. 5 is a right side view of the example of the straight brace member, with the left side view thereof appearing substantially the same.
Figure 5A:
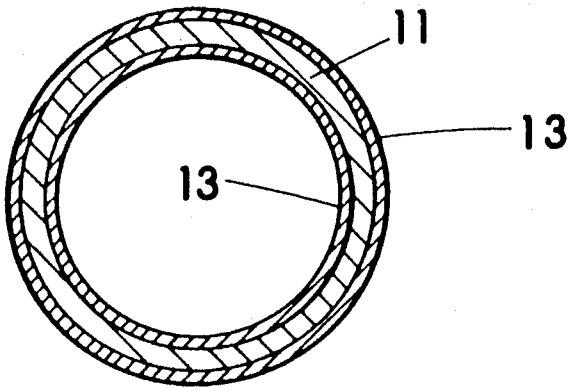

Referring now to the drawings in general where in FIG. 1, 2, and 3, a preferred first post bracing member 12 is shown, and in FIG. 4 and 5, a preferred straight post bracing member 14 is shown. Substantially identical bracing members 12 are used in pairs when bracing between two T-posts 28. FIG. 5 A being a cross section of brace member 14, is also representative of what a cross section of a preferred brace member 12 would appear if sectioned. The cross section of FIG. 5 A illustrates the preferred material structure of both brace members 12 and 14, which is mild steel 11, preferably tubing in form, having an interior and exterior coating of galvanized zinc 13 to prevent rust, although other rust preventatives such as paint could be used over the metal. Mild steel tubing having a coating of zinc is strong, light in weight, durable, and easily worked and formed with available tools such as punch presses and metal bending equipment. Galvanized steel tubing is also currently relatively inexpensive as compared to other possibly suitable materials such as aluminum tubing, or plastic or composite materials.

Bracing member 12 is comprised of a single piece of generally straight and rigid elongated galvanized steel tubing, having two oppositely disposed ends which have each been flattened for about six inches, and bent about 180 degrees into a U-shape or hook 16. Each hook 16 lies on the same side of the brace 12 as the other hook 16 as shown in FIG. 1 and 2. The terminal or distal end of each hook 16 is positioned in spaced apart relationship and generally parallel to the straight center body portion 15, leaving an open space or mouth 17 sufficiently wide to allow edgewise passage of a T-post 28 between the distal end of each hook 16 and center body portion 15. In each hook 16 is a pair of aligned apertures 18. One aperture 18 of each pair of apertures is positioned adjacent the distal end of each hook 16, and the other aperture 18 of each pair of aligned apertures 18 is positioned adjacent the juncture of each hook 16 with center body portion 15. Apertures 18 of each pair of aligned apertures 18 are aligned to allow passage of the shank of a hex headed bolt 24 through both apertures 18 of a pair of apertures in a hook 16 as shown best in FIG. 7 and 8. Bolt apertures 18 of both members 12 and 14 are sized for insertion of the shank of a hex headed bolt 24 which is affixed in position with nut 26, and it is desirable to use the same size nut 26 as the head of bolt 24 so as to allow the use of only one size wrench or socket used in pairs. Additionally, the use of suitably long bolts 24 will allow the bolts to be positioned in place in apertures 18 with nuts 26 engaged without having to compress hooks 16 inward until further tightening of nuts 26.

The tubular structure and material of manufacture of brace member 12 renders center body portion 15 substantially rigid, however, after the two oppositely disposed ends of the tubing is flattened and then bent into hooks 16, hooks 16 have a degree of flexibility. This flexibility is primarily due to the loss of the tubular shape of the material, and although hooks 16 are not highly flexible, they do have a degree of flexibility sufficient to allow the hooks 16 to be inwardly compressed with a small amount of force such as could be applied by inserting a bolt 24 through a pair of aligned apertures 18, applying a nut 26 to the threaded shank of bolt 24, and then tightening the bolt 24. This inward compressibility of hooks 16 allows the tightening thereof onto a T-post 28 for secure yet removable attachment to the post 28.

Figure 8:
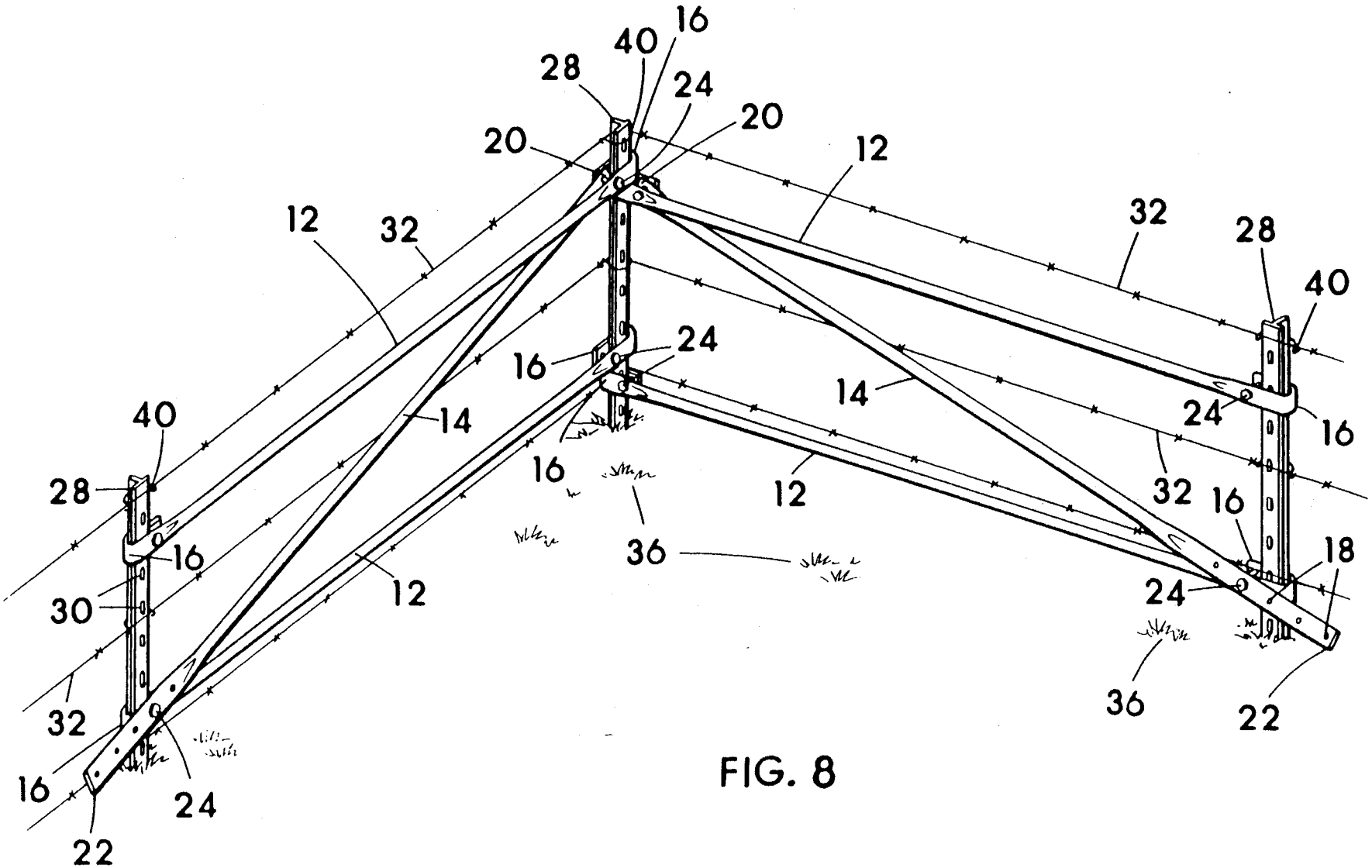
FIG. 8 is a perspective view illustrating a fence corner built in accordance with the invention of this disclosure.

Straight brace member 14 is also preferably an elongated rigid section of galvanized steel, preferably tubing, although other shapes and materials such as aluminum, plastics or composites probably could work within the scope of the invention. Brace member 14, being intended for use as a diagonal brace in combination with two horizontally disposed brace members 12, is sized slightly longer in overall length than brace member 12. Brace member 14 has a first end 20 and an oppositely disposed second end 22, both of which are flattened sections of the tubing. First end 20 is flattened approximately three to five inches in length and contains one central bolt aperture 18 placed close to the terminal end of the flattened section as shown in FIG. 4. As shown in FIG. 8, the placement of the aperture 18 closely adjacent the terminal end 20 of brace member 14 allows the affixment of end 20 with a bolt 24 within the interior of mouth 17 of hook 16 without interference from a T-post 28 within the center of the hook 16 hitting end 20.

Second end 22 of brace member 14 is flattened for an extended length of approximately eight to twelve inches or so, and contains a plurality of bolt holes 18 extending in an aligned row. Usually five bolt apertures 18 in second end 22 provides the intended functionality of an installer being able to adjust the in-use positioning of brace member 14 by selecting one of the five holes through which to insert an attachment bolt 24, which is important when installing fencing using my bracing members 12 and 14 on hills or otherwise un-level ground. The plurality of bolt apertures 18 in end 22 of member 14 further allows a wide range of choice in spacing between two horizontally disposed brace members 12 attached to two posts 28. The further apart the two horizontal brace members 12, the longer the brace member 14 must be to span the diagonal distance between the hooks 16. By being able to select the proper aperture 18 from a row of a plurality of adjacent apertures 18 in end 22, extra long or extra short T-posts 28 may be braced with two horizontally disposed brace members 12 placed with optimum spacing between the members 12, and further braced by the attachment of brace member 14.

Hooks 16, or at least the open space within the confines of hooks 16 of brace member 12, are sized for placement over the exterior of T-post 28, and further to allow free sliding of the hooks 16 upward and downward along the length of the posts 28 for easy placement thereof prior to clamping hooks 16 in place onto the posts 28. T-post 28, being a typical T-shaped post, is comprised of an elongated metal member, when viewed endwardly has the appearance of a "T". T-post 28 has an upper end, and an oppositely disposed lower end. One lengthwise flat side of T-post 28 contains a number of evenly spaced projections or lugs 30 which help secure the strands of barbed wire 32 or hog wire 38 in place. The interior space within hooks 16 is sized large enough for insertion over T-post 28 and lugs 30. The lower end of T-post 28 contains a flat, arrow shaped blade 34 which helps to guide T-post 28 as it is driven into the soil where the post is stabilized with the lower end thereof below grade level. T-posts 28 are normally driven into the ground with the upper end of the post sticking upward above grade level, and plumb or vertically oriented. Although T-posts 28 are preferred, other types of metal posts could possibly also be used in combination with my bracing members 12 and 14.

Figure 6:
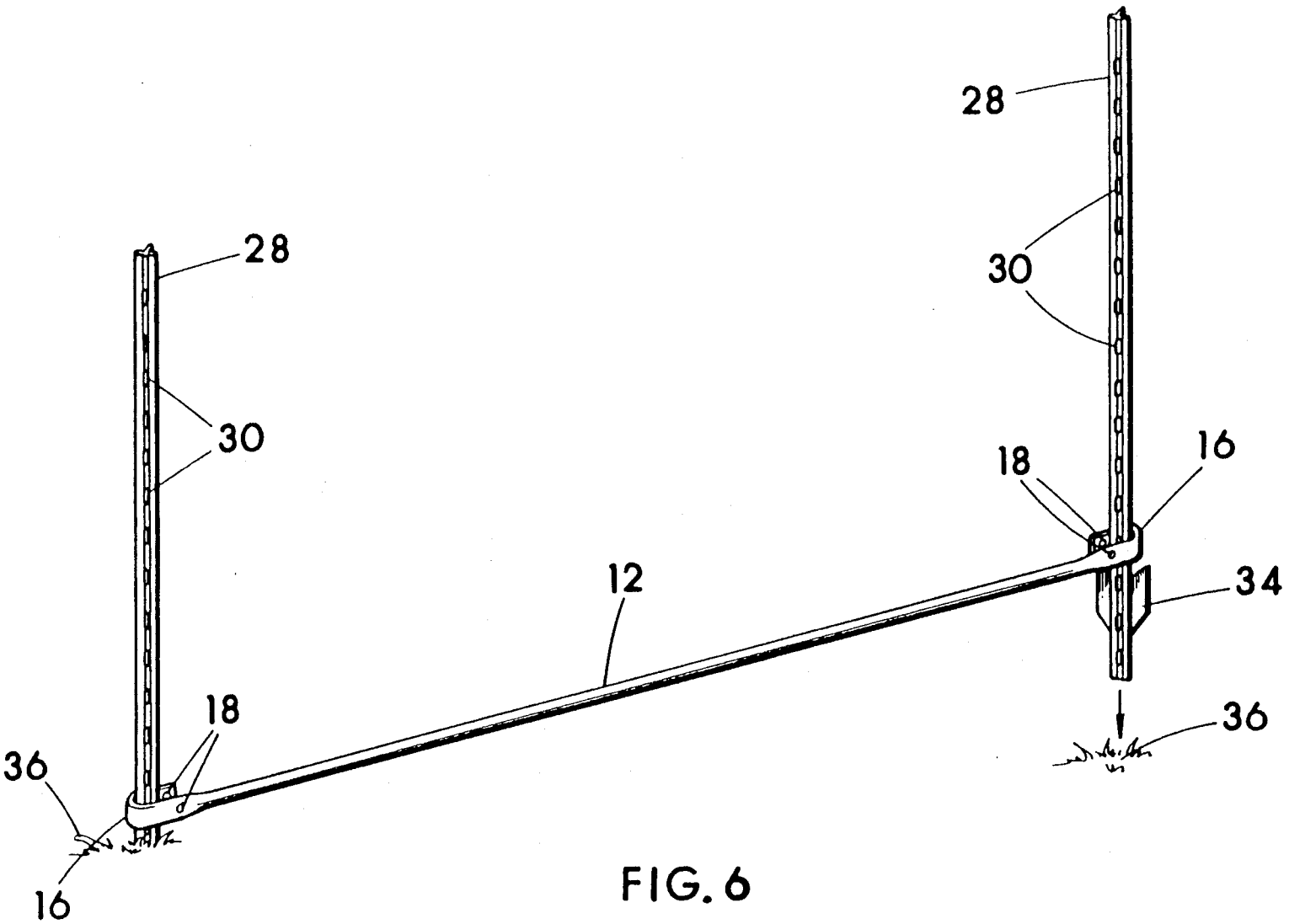
FIG. 6 is a perspective in-use illustration of the example of the first brace member and two T-posts, depicting the first brace member being utilized as a measuring gage to properly space a second T-post apart from the already set first T-post.
Figure 7:
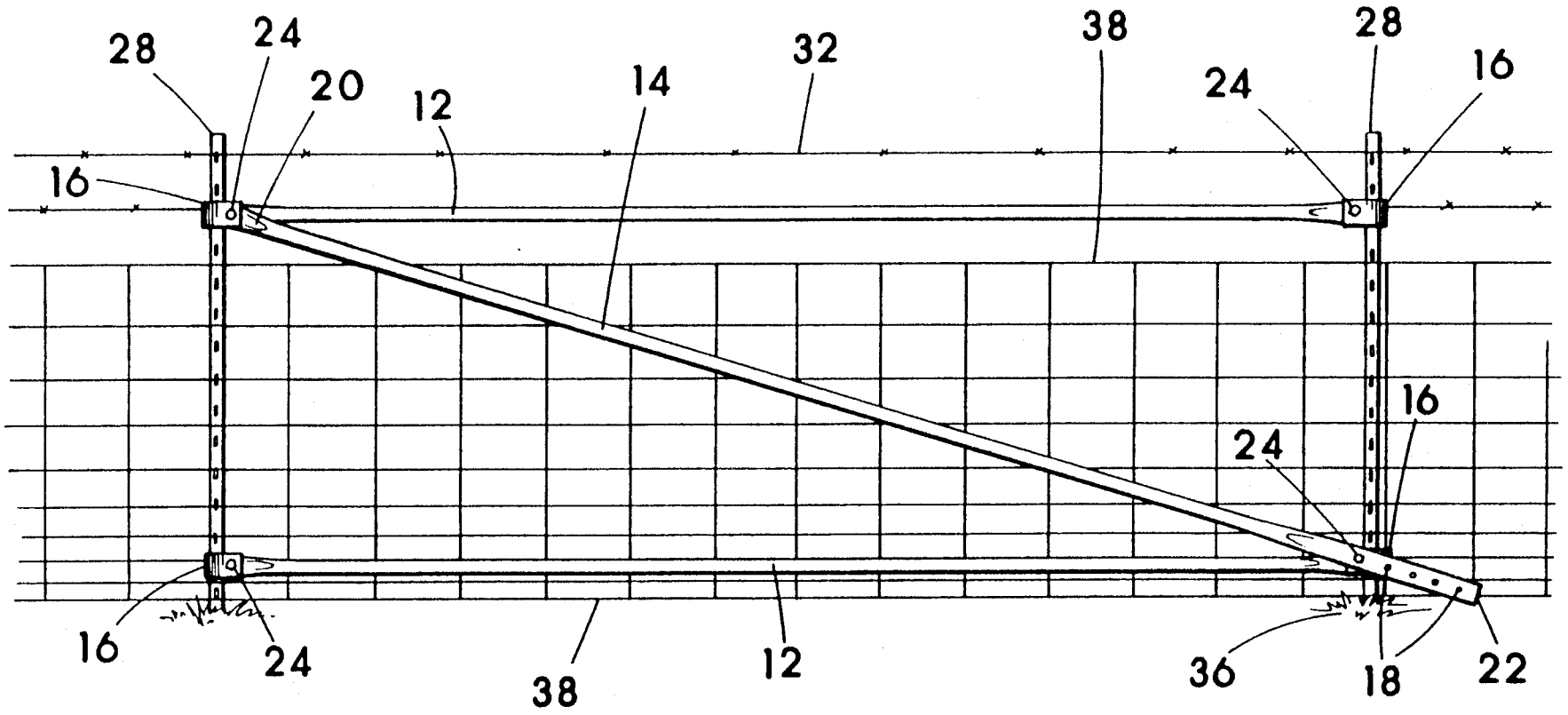
FIG. 7 illustrates a preferred relative position of assembly of the component parts of the invention when in use in a section of fence. A straight brace member is shown positioned diagonal, with two hooked end first brace members positioned horizontally on two T-posts. A combination of hog wire and barbed wire is shown as the fence wire attached to and spanning across the posts.

There are several slightly varying suitable methods in which to assemble a section of fence utilizing brace members 12 and 14, with the selection of any given procedural order being determined primarily by factors such as whether a single person or two people are working to install the section of fence, and additionally the skill and manual dexterity of the installer or installers. One of several suitable preferred methods to assemble a section of wire fence utilizing bracing members 12 and 14, is as follows, where the reader will gain greater understanding by examining drawing FIGS. 6, 7, and 8 as he reads:

A single T-post 28 is driven vertically into ground 36. The hook 16 of a brace member 12 is hooked around the bottom exposed end of the installed post 28 as shown in FIG. 6. The lower end of a second fence post 28 is inserted through the oppositely disposed hooked end of the brace member 12 as shown in FIG. 6 where the hook 16 is shown positioned above blade 24. The use of a brace member 12 as a measuring gage will provide a quick and simple method of determining the proper spacing between the two posts 28 for later attaching brace members 12 and 14. The second fence post 28 may be driven into the ground through the center of the hook 16, or the exact spot on the ground may be marked, the brace member 12 moved aside, and then the second fence post 28 may be driven vertically into the ground. Both fence posts 28 should be installed extending out of the ground 36 vertically oriented. After both posts 28 have been properly installed, a brace member 12 is lowered over the top ends of both installed T-posts 28 and lowered down to ground 36 with posts 28 within the interior of hooks 16 as may be ascertained from the drawings. The two hooks 16 of a second brace member 12 are then fitted over the top ends of both installed T-posts 28, with one hook 16 being secured to a post 28 with a lightly tightened nut 26 and bolt 24 inserted through a pair of aligned apertures 18. The first end 20 of straight brace member 14 is then inserted within mouth 17 of the unbolted hook 16 of the upper brace member 12, and aperture 18 of first end 20 and the pair of aligned apertures 18 of hook 16 are aligned. A bolt 24 is then passed through all three aligned apertures 18 and secured in position with a lightly tightened nut 26. The opposite end or second end 22 of straight brace member 14 is then angled downward toward the oppositely disposed post 28 where end 22 is positioned on the exterior of hook 16 of the lower brace member 12, preferably raising the right hook 16 of the lower brace member 12 approximately four or five inches from ground 36 to keep the member off of the possibly corrosive dirt. One aperture 18 of second end 22 of brace member 14, is aligned with the pair of apertures 18 of hook 16 of the lower brace member 12. A bolt 24 is then inserted into the three aligned bolt apertures 18 and secured in position with nut 26 lightly tightened. The remaining or oppositely disposed hook 16 of the lower brace member 12 which is absent an end of member 14 is then moved up or positioned level with the opposite end thereof, and secured in position with a bolt 24 and nut 26 lightly tightened. Nuts 26 and bolts 24 may be tightened only sufficiently to lightly retain members 12 in place on posts 28 until members 12 and 14 have been tied to each other, at which point the installer may make slight adjustment ensuring horizontal and parallel positioning of members 12. On uneven ground, brace members 12 are positioned generally parallel with the ground, and parallel with each other. After the installer is satisfied with the positioning of all three members 12 and 14, all nuts and bolts 26 and 24 may be fully tightened thereby compressing hooks 16 tightly onto T-posts 28 for a secure yet removable attachment. Barbed wire 32 or hog wire 38 is then stretched spanning between the T-posts 28 and across any additional fence posts 28 in the fence as is desired, followed by stretching the wire tight, and then securing the wire to each post 28 between lugs 30 with snap-on clips 40 or other suitable fasteners. To create a braced fence corner as shown in FIG. 8, generally the preceding steps are followed, only three T-posts 28 are utilized wherein essentially two fence sections as shown in FIG. 7 are affixed together at right or any other desired angles to each other with the joining of the two fence sections being at the corner post 28 which is jointly used for the attachment of brace members 12 and 14.

Although not shown in the drawings, it should be noted that, if desired, two or more three member brace arrangements may be utilized attached to and spanning between two T-posts 28 for added strength and rigidity. In this case, in FIG. 7, there would be three or four brace members 12 and at least two brace members 14 on the two T-posts 28 shown. Also in this situation, even if wire 32 or 38 is not utilized spanning across the posts 28, there may be sufficient bracing members 12 and 14, with sufficiently narrowed spacing therebetween to utilize a plurality of such fence sections as a temporary corral for livestock. When used for this purpose, bracing members 12 and 14 are especially well suited, since removal of the bracing members 12 and 14 is quick and easy, and the posts 28 could be pulled from the ground, or left in place for next years round-up.

Also, although not shown in the drawings, it should be noted that for bracing and further stabilizing an existing fence with my bracing members 12 and 14, one hook 16 of brace member 12 would be hooked around an existing post 28 leaving the fencing wire 32 or 38 attached to the existing post. This is due to the open mouth 17 of hooks 16 which eliminates the necessity of sliding the hooks 16 downward over the ends of posts 28. An additional new fence post 28 would be installed adjacent the existing fence wire the proper distance from the existing post 28 as determined by a brace member 12 used as a measuring gage. A second brace member 12 and a straight brace member 14 would then be attached accordingly between the existing post 28 and the new additional post 28. The existing fence wire may or may not be attached to the new fence post depending on the situation. In any case, the existing fence post 28 has been braced, without disturbing the existing wire. Furthermore, the new additional post 28 used to brace and stabilize an existing fence does not always have to be directly adjacent the existing fence wire, but could be placed off at an angle relative to the fence, and still provide a suitable bracing job.

Although I have described my invention in great detail, those skilled in the art will recognize changes may be made in the specific details given and shown in the drawings without departing from the invention, and therefore the scope of the invention should be determined by the scope of the appended claims.

I claim:

1. A fence post bracing member for use in a section of fence, comprising;

an elongated tubular center portion having two oppositely disposed flattened terminal ends, each of said flattened terminals ends bent into a hook having a distal end in spaced apart relationship with said tubular center portion;

each said hook having at least a pair of aligned apertures therethrough, one aperture of each said pair of aligned apertures placed adjacent each of the distal ends of said hooks, and the other said aperture of each said pair of aligned apertures placed adjacent a juncture between each said hook with said tubular center portion;

said tubular center portion being substantially rigid;

said hooks formed of said flattened terminal ends of said tubular center portion having a degree of flexibility sufficient to allow said hooks to be inwardly compressed onto a fence post with a tightenable fastening means inserted through said pair of aligned apertures and tightened.

2. A fence post bracing member for use in a section of fence, comprising; an elongated substantially rigid and substantially straight center portion, each of two oppositely disposed ends of said center portion structured into a flexible hook having a pair of aligned apertures therethrough, said flexibility of said hooks being sufficient to provide means allowing said hooks to be inwardly compressed onto a fence post by clamping means within said apertures.

3. A fence post bracing member according to claim 2 wherein said center portion is tubular, and each of said two oppositely disposed ends are flattened portions of the center tubular portion which are bent into said hooks.

4. A fence post bracing member according to claim 3 wherein said center tubular portion is structured of steel tubing having a coating of corrosion protective material.

5. A fence post bracing member according to claim 4 wherein said corrosion protective material is galvanized zinc.

6. A section of fence reinforced by bracing members, comprising in combination;

a T-shaped first fence post affixed vertically oriented, and a T-shaped second fence post affixed vertically oriented and in spaced apart relationship to said first fence post;

an elongated upper bracing member having two oppositely disposed hooked ends, said upper bracing member spanning generally horizontally disposed between said first and said second fence posts, one of said hooked ends of said upper bracing member releasably affixed around said first fence post, and one of said hooked ends of said upper bracing member releasably affixed around said second fence post;

an elongated lower bracing member having two oppositely disposed hooked ends, said lower bracing member spanning generally horizontally disposed between said first and said second fence posts, one of said hooked ends of said lower bracing member releasably affixed around said first fence post, and one of said hooked ends of said lower bracing member releasably affixed around said second fence post, said lower bracing member positioned on said fence posts below said upper bracing member;

an elongated substantially straight diagonal bracing member having two oppositely disposed ends, one said end of said diagonal bracing member releasably affixed to one said hooked end of said upper bracing member, and one said end of said diagonal bracing member releasably affixed to one said hooked end of said lower bracing member, said releasably affixed diagonal bracing member extending at an angle from adjacent said first fence post to adjacent said second fence post;

fencing wire spanning between and affixed to said first fence post and said second fence post.

7. A method of installing a braced section of fencing comprising;

setting a first fence post having an upper end and a lower end vertically oriented with said lower end stabilized below grade level, utilizing a suitable fence post bracing member as a measuring gage to determine a proper distance from said first fence post to set a second fence post, said second fence post having an upper end and a lower end, setting said second fence post vertically oriented with said lower end stabilized below grade level a distance from said first fence post as determined by said fence post bracing member, said fence post bracing member being of a type having an elongated substantially rigid and substantially straight center portion, each of two oppositely disposed ends of said center portion structured into a compressible hook having a pair of aligned apertures therethrough, bracing between said first and said second fence posts utilizing two substantially identical said fence post bracing members each placed horizontally disposed spanning between said first and second fence posts with said first fence post within one of said hooks of each said fence post bracing member, and said second fence post within said oppositely disposed hooks of each said fence post bracing member, placing one of said fence post bracing members adjacent said upper ends of said first and said second fence posts, and placing the other one of said two substantially identical fence post bracing members below said fence post bracing member adjacent said upper ends of said fence posts, utilizing a third bracing member of a type which is elongated and substantially straight and rigid, said third bracing member further having at least one aperture therethrough at each of two oppositely disposed ends thereof, affixing said third bracing member as a diagonal brace by way of affixing one apertured end of said third bracing member to one said hook of the upper horizontally disposed fence post bracing member with a tightenable fastening means inserted through said pair of aligned apertures in said hook and through said aperture in said third bracing member, positioning said third bracing member extending downward at an angle toward the oppositely disposed said fence post and affixing a distal apertured end of said third bracing member to said hook of the lower horizontally disposed fence post bracing member with a tightenable fastening means inserted through said pair of aligned apertures in said hook and through said aperture in said third bracing member, affixing said hook of the upper horizontally disposed fence post bracing member being absent an end of said third bracing member to said fence post with a tightenable fastening means inserted through said pair of aligned apertures in said hook, affixing said hook of the lower horizontally disposed fence post bracing member being absent an end of said third bracing member to said fence post with a tightenable fastening means inserted through said pair of aligned apertures in said hook, affixing fence wire to and spanning across said first and said second fence posts.

8. A method of installing a section of fencing according to claim 7 further including utilizing said third bracing member of a type further having a plurality of apertures at one end therefore, with said plurality of apertures providing means of adjustably attaching said third bracing member as a diagonal brace.

* * * * *